US008826615B2

(12) United States Patent
Feigl

(10) Patent No.: US 8,826,615 B2
(45) Date of Patent: Sep. 9, 2014

(54) PROTECTIVE WALL

(76) Inventor: Bernhard Feigl, Lochau (AT)

( * ) Notice: Subject to any disclaimer, the term of this patent is extended or adjusted under 35 U.S.C. 154(b) by 0 days.

(21) Appl. No.: 13/199,026

(22) Filed: Aug. 17, 2011

(65) Prior Publication Data

US 2012/0043034 A1 Feb. 23, 2012

(30) Foreign Application Priority Data

Aug. 19, 2010 (EP) ..... 10173341

(51) Int. Cl.
*E04H 1/00* (2006.01)
*E04F 11/18* (2006.01)

(52) U.S. Cl.
CPC ..... *E04F 11/1851* (2013.01); *E04F 11/1812* (2013.01)
USPC ..... 52/238.1; 52/208; 256/24

(58) Field of Classification Search
CPC ..... E04H 17/16; E04H 17/22; E04H 17/20; E04B 1/3404; E04B 2/7854; E04B 2/7457; E04G 21/26; F16M 13/00; A47B 91/00
USPC ..... 160/368.1; 52/73, 238.1, 241; 248/127, 248/121, 156, 188.1, 188.8; 256/24
See application file for complete search history.

(56) References Cited

U.S. PATENT DOCUMENTS 4,841,697 A * 6/1989 Hogg et al. ..... 52/208
5,603,192 A * 2/1997 Dickson ..... 52/238.1
6,912,817 B1 * 7/2005 Sabac et al. ..... 52/204.54
6,964,410 B1 * 11/2005 Hansen ..... 256/24
7,559,536 B1 * 7/2009 Hansen et al. ..... 256/25
7,614,583 B2 * 11/2009 White ..... 244/118.1
7,775,003 B2 * 8/2010 Sabac et al. ..... 52/204.62
7,797,901 B2 * 9/2010 Near ..... 52/481.1
8,181,405 B2 * 5/2012 Nash ..... 52/238.1
8,327,591 B2 * 12/2012 Wilkinson, Jr. et al. ..... 52/243.1
2011/0219722 A1 * 9/2011 Feigl ..... 52/705

FOREIGN PATENT DOCUMENTS

| | | |
|---|---|---|
| DE | 201 11 872 | 10/2001 |
| DE | 103 38 816 | 5/2005 |
| DE | 10 2006 028766 | 12/2007 |
| EP | 1 700 990 | 9/2006 |

* cited by examiner

*Primary Examiner* — Katherine Mitchell
*Assistant Examiner* — Johnnie A Shablack
(74) *Attorney, Agent, or Firm* — Pandiscio & Pandiscio

(57) ABSTRACT

A protective wall releasably connectable to a floor, the wall comprising panels, a U-section rail with legs extending in parallel, and a web gripping the panels and locked thereon. A U-shaped holding pocket is disposed on free ends of the legs of the rail and is disposed such that a holding plate is insertable into each holding pocket, the holding plates being attached to a holding fixture fixed onto a floor, a holding groove is provided on an outside of the web, and a locking body is disposed in the holding groove, such that the locking body is supported on the holding fixture and is mounted such that it is moveable in a horizontal direction relative to the holding fixture.

5 Claims, 3 Drawing Sheets

PROTECTIVE WALL

BACKGROUND OF THE INVENTION

1. Field of the Invention

The invention relates to a protective wall releasably connectable to a floor.

2. Description of the Prior Art

A holding fixture for a glass panel of a balustrade is disclosed in EP 2194207 A1. The glass panel is inserted in a U-section and glued therein, with the effect that the glass panel and the U-section are firmly connected to one another at a factory, in order to be subsequently connected to a building floor by means of a holding fixture attached to the floor.

The balustrade serves in particular as a means of preventing falling from a balcony, stairs, or an intermediate floor in a building, with the effect that legally specified safety standards regarding the stability of the balustrade are complied with and reliable protection against falling is achieved in case of high lateral loadings, and protection against falling is reliably provided on an intermediate floor or balcony, even after a certain service life, and will withstand loadings.

Furthermore, a groove is provided on the outside of a web of the U-section rail and a setting plate is inserted in the groove. The setting plate is connected with a threaded pin held in a section attached to the intermediate floor as a holding fixture. The pin passes through a nut which is inserted in the section in a positionally oriented and rotationally fixed manner, with the effect that when the threaded pin is rotated, it is moved in the direction of the intermediate floor, or moved away from it, so that the holding plate thereby exerts a horizontal force on the underside of the section rail, as a result of which a vertical, i.e. perpendicular, setting of the entire balustrade is achieved.

The U-section rail is provided with a U-shaped holding pocket hooked onto the holding fixture that is to be attached to the intermediate floor. Furthermore, the underside of the U-section rail lies on a housing which is firmly attached to the holding fixture, with the effect that the housing and the holding fixture support the balustrade in a vertical direction.

Designs of this kind have proven themselves in practice in balustrades as protection against falling, although they cannot be used for protective walls that are to be erected on a floor, because such balustrades require unobstructed access to an end face of the fixed floor, or wall, in order to support the U-section rail reliably on the floor by means of the holding fixture.

Furthermore, it has proven to be necessary for protective walls used, for example, for protecting against wind, driving rain, or sunshine, in the area of terraces, to be installed and removed again quickly and in a straightforward manner.

SUMMARY OF THE INVENTION

It is, therefore, a task of the present invention to provide a protective wall of the aforementioned kind based on the balustrade of prior art which is reliably supported on a floor and (even given considerable wind loadings or other external loading situations), and can be installed and removed quickly and easily.

These purposes are achieved in accordance with the present invention.

The U-section rail, together with the panel inserted therein, can be pushed onto two holding plates running in parallel with one another and attached to a holding fixture, because a U-shaped and outwardly projecting holding pocket is formed onto each of the two free ends of a leg. The holding fixture, in turn, is connected to the floor in a releasable connection which is firm when it is attached, with the effect that the holding fixture, and thereby the holding plates, reliably support the U-section rail and the panel inserted in it on the floor. The holding fixture can be attached to the floor quickly and easily and/or the U-section rail can be disconnected from the holding fixture, which means that the installation or removal of the panels can be performed quickly by users who do not require any specialist training or knowledge in order to do this.

Moreover, it is a particularly advantageous feature that the U-section rail is provided with a holding groove on the outside of the web and a locking body engages in the holding groove, with the locking body being mounted in a vertical direction on the holding fixture and movable in a horizontal direction in relation to the holding fixture. By this means, for example by moving the locking body, it is possible to align the panel perpendicularly in parallel with the surface of the floor. Straightforward installation tools, such as a screwdriver, can be used for this purpose.

In order to provide additional support for the holding fixture on the floor, a stabilisation plate may be inserted between the holding fixture and the floor, in which case the stabilisation plate projects beyond the outer contour of the holding fixture with the effect that objects, such as flower tubs and concrete slabs, can be placed on the stabilisation plate in order to increase the load.

Stabilisation of the holding fixture is increased in an advantageous manner in particular in that a web is provided between the upper holding plate inserted in the holding pocket of the U-section rail and the legs of the holding fixture running parallel to the floor, with the effect that the holding fixture together with the holding plate have a triangular cross-sectional contour. In case of particularly high loadings, such as between housings in which there can be flows of air from both sides, the web is also formed onto the second holding plate so that the holding plates, together with the holding fixture, form a triangular cross-sectional contour. As a result, the holding plates are additionally supported on each of their outer sides by means of the web on the holding fixture.

In order to increase the stability and the stiffness of the two holding plates, as well as to lock adjacent U-section rails, plate-shaped connecting elements are provided which can be pushed in sideways between two holding lugs arranged flush with one another on each U-section rail. As a result, two U-section rails can be assembled in alignment with one another, or for forming a corner, by means of the connecting elements.

BRIEF DESCRIPTION OF THE DRAWINGS

The drawings show three sample embodiments in accordance with the present invention, in a sectional view in each case, the details of which are explained below. In the drawings.

DESCRIPTION OF THE PREFERRED EMBODIMENTS

Figure 1:
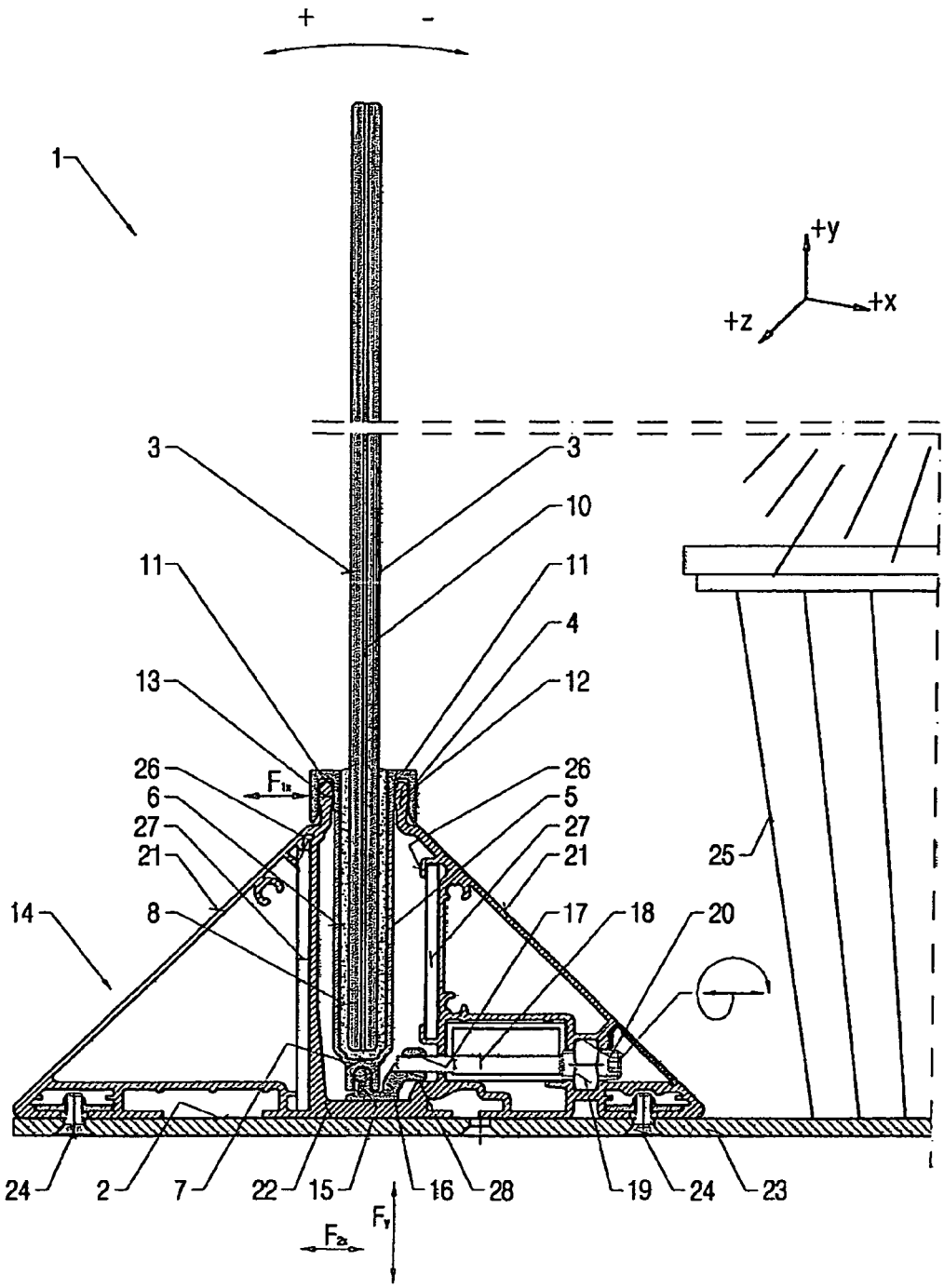
FIG. 1 is a sectional view showing a first illustrative embodiment of a protective wall with a U-section rail and with a holding fixture which comprises two substantially mirror-image triangular cross-sectional contours.

In FIG. 1 there is shown a protective wall 1 by means of which drafts are prevented in the area of terraces, in order to protect people against drafts, for example. The protective wall 1 is mounted on a floor 2 by means of a holding fixture 14 explained in more detail below, with the effect that the protective wall 1 can withstand loadings caused by the effect of wind force and does not fall over as a result. Furthermore, the protective wall 1 should be able to be installed in and removed from the holding fixture 14 as quickly and easily as possible, in order to allow the wall 1 to be protected from frost and other damage during winter months, by keeping the wall in storage rooms.

The protective wall 1 comprises a U-section rail 4 in which, in the illustrated embodiments, two panels 3 are firmly installed at a factory by means of a layer of glue 8. The two panels 3 are secured together by a foil 10 to form a pane of safety glass. This means the panels 3 and the U-section rail 4 form a single assembly which, as has been mentioned, can be released from the holding fixture 14, or connected to it, quickly and easily.

This is achieved in that a U-shaped holding pocket 11 is formed on each U-section rail 4, specifically on two legs 5 and 6 projecting outwards, and the opening in the pocket 11 runs parallel to the panels 3. The holding fixture 14 comprises two holding plates 12 and 13 extending parallel to one another and to the panels 3. The two holding plates 12 and 13 are attached to a common support plate 22 at their bottom end facing the floor 2. The support plate 22 is connected to the floor 2 by means of mounting screws 24, with the effect that the holding plates 12 and 13 forming the holding fixture 14, as well as the support plate 22, are firmly attached to the floor 2.

The holding pockets 11 of the U-section rail 4 can accordingly be hooked onto the two holding plates 12 and 13, with the effect that the holding pockets 11 run along an identical height level. The holding pockets 11 are formed onto the U-section rail 4 corresponding to the alignment of the holding plates 12 and 13. It is also possible, without further trouble, for the holding pockets 11 to be arranged on different height levels, if the two holding plates 12 and 13 are on different heights due to local conditions.

If possible, there should not be an air gap between the two vertical legs of the holding pocket 11 and the outside/inside of the corresponding holding plate 12 or 13, in order to support horizontal loadings in the X-direction in accordance with the indicated system of coordinates. The end surfaces of the holding plates 12 and 13 projecting freely upwards are, however, not in contact with the inside of the holding pocket 11; rather, there should be an air gap between the holding pocket 11 and free ends of the holding plates 12 and 13. This is because vertical loads should not be transferred through the holding pocket 11 onto the holding plates 12 and 13. Also, the air gap is necessary between the free leg of the corresponding holding pocket 11 and the outside of the holding plate 12 or 13, in order to exclude any force transmission in this area.

The U-section rail 4 comprises the two legs 5 and 6 running in parallel with one another, which are aligned in parallel with the panel 3. A web 7 of the U-section rail 4, which interconnects the legs 5 and 6, is arranged in between the legs 5 and 6. A holding groove 15 is formed on the outside of the web 7, with the cross-sectional contour of the groove 15 having a U-shape. The holding groove 15 in the web 7 is adapted to absorb vertically and horizontally acting forces and transmit them to the holding fixture 14.

For this purpose, there is a locking body 16 inserted in the holding groove 15, the cross section of which locking body 16 is principally configured in an L-shape. A block 28 is formed onto one leg of the locking body 16 which is inserted into the holding groove 15. An air gap is provided between the upper side of the block 28 and the inside of the holding groove 15. The two legs forming the holding groove 15 run along the side adjacent to the block 28 and are in contact with it, thereby allowing horizontal forces to be transferred in the X-direction. Furthermore, the free end surfaces of the legs of the holding groove 15 are supported on the surface of the locking body 16, with the effect that the vertical forces, i.e. loadings vectored in the Y-direction, are transferred onto the locking body 16 by means of the end faces of the holding groove 15.

The locking body 16 is in contact with the support plate 22 of the holding fixture 14 and can be moved relative to it in the Y-direction. In order to carry the vertical forces from the locking body 16 to the holding fixture 14, there is a holding opening 17 worked into the locking body 16 and a threaded rod 18 is inserted in the opening 17 in a rotationally fixed and positionally oriented manner. The threaded rod 18 extends parallel with the floor 2 and can be accessed from externally. In an outer area of the holding fixture 14, there is a nut 19 screwed onto the threaded rod 18 and the nut 19 is supported in a rotationally fixed and positionally oriented manner in a pocket 20 disposed in the holding fixture 14. The drawings show that the threaded rod 18 can be rotated about its lengthways axis. As soon as the threaded rod 18 is screwed in, for example in the direction of the panel 3, the threaded rod 18 presses the locking body 16 away from the nut 19; the distance between the nut 19 and the block 28 is consequently increased. This means that the panel 3 is tilted to the right. If, on the other hand, the threaded rod 18 is screwed in the opposite direction into the nut 19, the locking body 16 is pulled towards the nut 19, with the effect that the distance between the block 28 and the nut 19 is reduced and the panel 3 is tilted to the left. This adjustment feature means that the panel 3 can be aligned vertically, for example, in order to compensate for tolerances in manufacture.

A stabilisation web 21 is provided between the two holding plates 12 and 13 running in the area of the holding pocket 11 and the support plate 22 of the holding fixture 14. Accordingly, the holding plates 12 and 13 form a triangular cross-sectional contour together with the stabilisation web 21 and the support plate 22, by means of which the torsional rigidity of the holding fixture 14 is increased, with the effect that the holding plates 12 and 13 are reliably held in position, even in case of vertical loadings, such as due to wind load.

In order to improve the stability of the holding fixture 14 further, holding lugs 26 spaced apart from one another are arranged on each of the holding plates 12 and 13, between which lugs 26 a connecting element 27 with a plate-shaped configuration can be inserted. If the connecting element 27 is inserted in the holding lugs 26 in a positionally fixed arrangement, the wall thickness of the holding plates 12 or 13 is increased by the wall thickness of the connecting elements 27, with the effect that stabilising effects are provided.

Furthermore, the connecting elements 27 project beyond the U-section rail 4, with the effect that another U-section rail 4 can be attached for extending the entire protective wall 1 by means of the two connecting elements, in such a way that the two adjacent U-section rails 4 can be flush-fixed. The connecting elements 27 can also be bent to a specified angle, with the effect that two adjacent U-section rails 4 can be locked together at an angle, such as 90°, by means of the two connecting elements 27.

Often, it is difficult to support the holding fixture 14 reliably on the leg 6, therefore a stabilisation plate 23 is provided to improve the effective connection between the holding fixture 14 and the floor 2, in which case the plate 23 can be attached to the support plate 22 of the holding fixture 14 by means of mounting screws 24. The stabilisation plate 23 projects beyond the holding fixture 14 in this case, with the result that objects, for example flower tubs 25, can be placed on this projecting area of the stabilisation plate 23. The weight of the flower tubs 25, or concrete slabs, or the like, means that the holding fixture is supported in its lateral area, with the effect that the stability of the protective wall 1 can also be increased by this measure.

Figure 2:
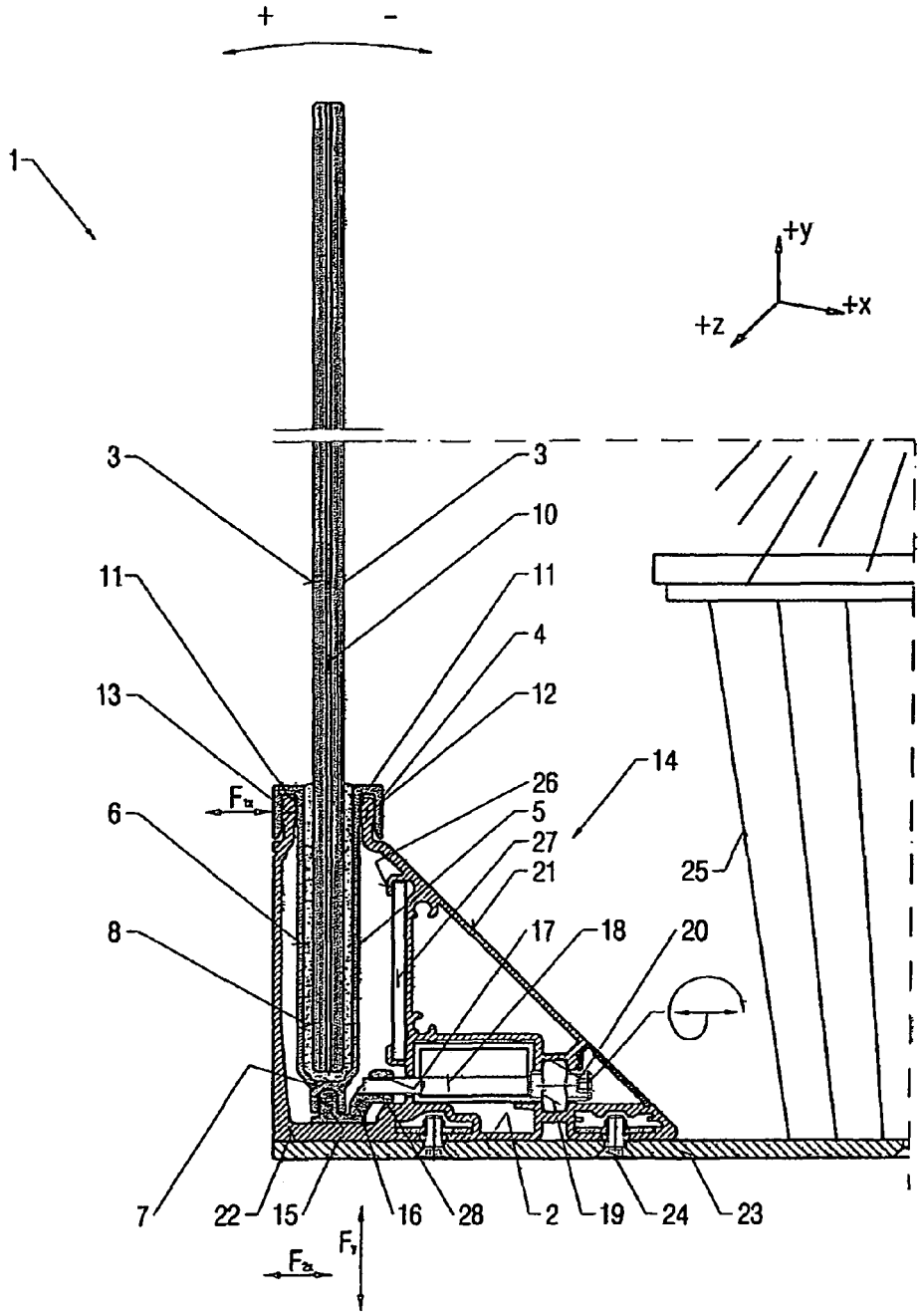
FIG. 2 is a sectional view showing a second embodiment of a protective wall with a U-section rail and with a triangular holding fixture on one side.

FIG. 2 shows the holding fixture 14 configured in such a way that it only has the stabilisation web 21 between the holding plate 12 and the support plate 22. The adjacent holding plate 13 is directly and exclusively attached to the support plate 22.

Figure 3:
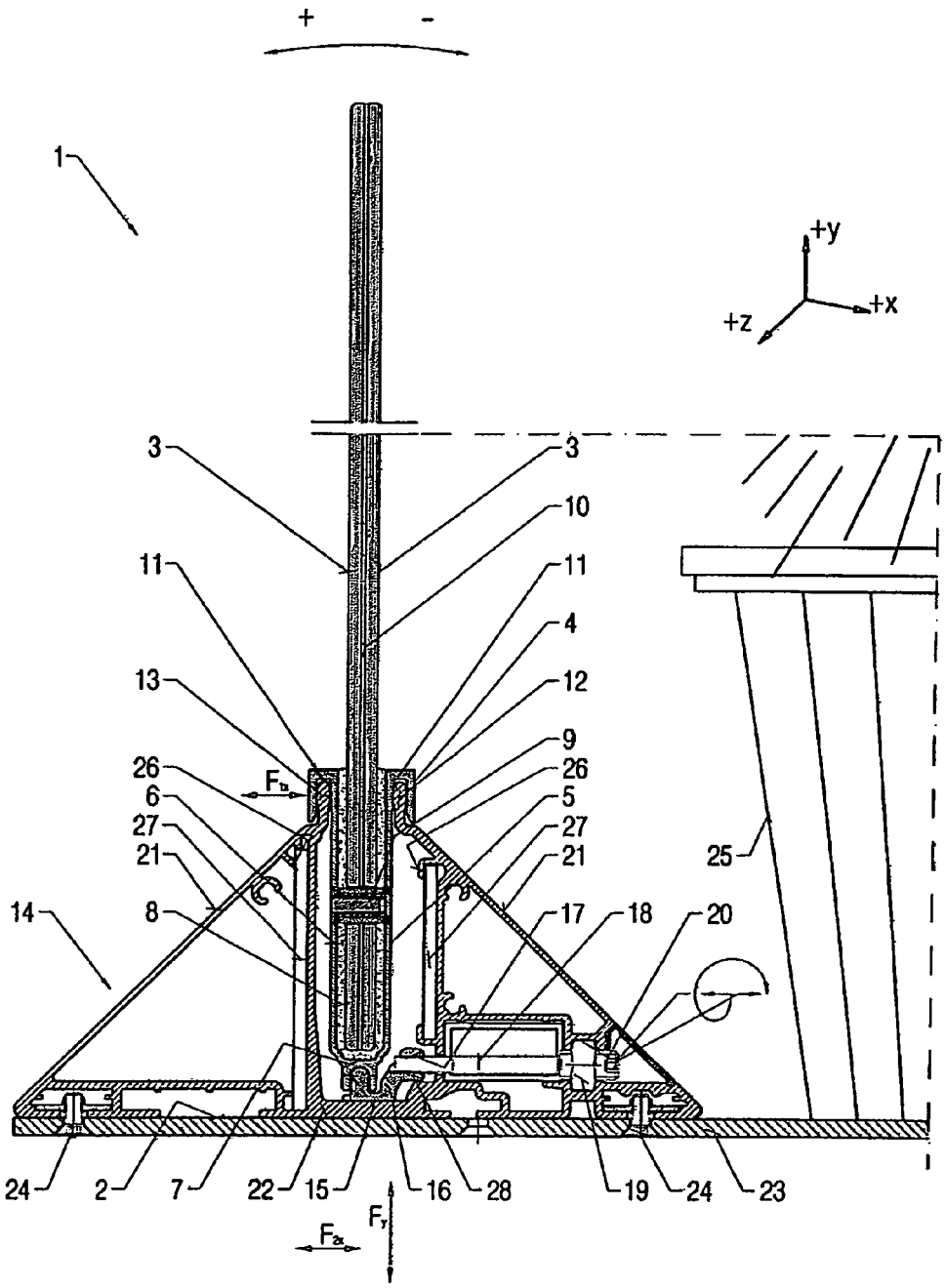
FIG. 3 is a sectional view showing a protective wall with a U-section rail and with a double-sided cross-sectional contour, in a triangular configuration of the holding fixture, in which the panel is held in the U-section rail by means of one or more screws.

FIG. 3 shows the panel 3 firmly connected to the U-section rail 4 by means of a plurality of screws 9.

The invention claimed is:

1. A protective wall assembly releasably connectable to a floor, the wall assembly comprising panel means forming wall surfaces, and panel holding means comprising two opposed inverted U-section rails, each provided with an inner leg, the two inner legs spaced from each other and extending in parallel and defining a closed end, and a web extending centrally axially from the closed end, wherein the two inner legs retain said panel means and are fixed thereto, wherein inverted U-shaped holding pocket means are defined by upper free ends of the inner legs of each U-section rails and the holding pocket means are disposed such that first and second parallel holding plates extending parallel thereto are insertable, respectively, into opposed ones of said holding pocket means, said holding plates each extending from a stabilizing web having a support plate portion connectable to the floor, a holding pocket groove being provided on an end of said web of said U-section rail, and a locking body slideably mounted on the support plate and having a protrusion extending therefrom and insertable into the holding pocket groove disposed in said web and fixed on said locking body and extending outwardly from said locking body, said locking body being slideably moveable on the support plate;

wherein said locking body is provided with a projection extending in a direction of the holding pocket groove in said web, and an end contour of said locking body is complementary to an inside contour of said holding pocket groove and is adapted to make engaging contact therewith;

wherein free ends of said holding pocket groove engage with a surface of said locking body to support vertical loadings; and wherein an opening extends through said locking body and parallel to the floor, a threaded rod is disposed in the opening and extends parallel with the floor, and said threaded rod passes through a nut disposed at an end of said rod remote from said locking body, the nut being supported in a positionally oriented manner.

2. The protective wall in accordance with claim 1, wherein a stabilization plate is fixed to and projects beyond the support plate at a bottom of a holding fixture, and receives weight bearing objects thereon.

3. The protective wall in accordance with claim 1, wherein said panel means forming the protective wall are locked in said U-section rail.

4. The protective wall in accordance with claim 1, wherein each of the first and second holding plates is provided with holding lugs formed thereon and spaced apart, and a connecting element is insertable between the holding lugs of each holding plate.

5. The protective wall in accordance with claim 1, wherein a holding fixture pocket means supports a plurality of said panel means, wherein said panel means are spaced from one another, so as to jointly form the protective wall.

* * * * *